United States Patent [19]

Kuehnel

[11] Patent Number: 4,922,471

[45] Date of Patent: May 1, 1990

[54] CAPACITIVE SOUND TRANSDUCER

[75] Inventor: Wolfgang Kuehnel, Darmstadt, Fed. Rep. of Germany

[73] Assignee: Sennheiser Electronic KG, Wedemark, Fed. Rep. of Germany

[21] Appl. No.: 319,602

[22] Filed: Mar. 6, 1989

[30] Foreign Application Priority Data

Mar. 5, 1988 [DE] Fed. Rep. of Germany ..... 3807251

[51] Int. Cl.[5] ..... H04R 17/00

[52] U.S. Cl. ..... 367/181; 381/174; 381/175; 381/191; 29/25.42

[58] Field of Search ..... 367/181; 381/191, 174, 381/175; 29/25.42

[56] References Cited

U.S. PATENT DOCUMENTS

| | | | |
|---|---|---|---|
| 3,624,315 | 11/1971 | Broce | 381/175 |
| 3,835,264 | 9/1974 | Overby | 381/175 |
| 4,524,247 | 6/1985 | Lindenberger et al. | 381/174 |
| 4,533,795 | 8/1985 | Baumhauer, Jr. et al. | 381/174 |
| 4,558,184 | 12/1985 | Busch-Vishniac et al. | 381/191 |
| 4,691,363 | 9/1987 | Khanna | 381/191 |

*Primary Examiner*—Deborah L. Kyle
*Assistant Examiner*—J. Woodrow Eldred
*Attorney, Agent, or Firm*—Klein & Vibber

[57] ABSTRACT

Capacitive sound transducer of a very small construction, in particular a microphone has at least two joint semiconductor chips, which embody a membrane unit and a fixed counter-electrode structure. The acoustic active portion of the membrane unit 1 with at least one counter-electrode structure 3, which is separated from the membrane unit by means of an air gap, forms a system which is comparable to a field effect transistor. The membrane unit which is formed of a semiconducting ground material encompasses an acoustically active membrane surface (2), one side 5 of which confronts the counter-electrode structure is electrically conductive.

The counter-electrode structure 3 has a semiconductive base material out of which there is machined a channel length which has been limited by a source-drain arrangement, the geometric width measurement of which is on the order of magnitude of a tenth of the lateral measurement of the active membrane surface.

6 Claims, 3 Drawing Sheets

CAPACITIVE SOUND TRANSDUCER

FIELD OF THE INVENTION

The invention relates to a capacitive sound transducer having a membrane unit and at least one fixed counter-electrode structure which is made out of semiconductive material. The transducer serves as a microphone for conversion of sound pressure changes into electrical signals.

BACKGROUND OF THE INVENTION

Capacitive microphones having a membrane and at least one fixed counter-electrode are known generally. In the known microphones, the membrane is prestressed by means of which the acoustic properties of the microphone capsule can be influenced. The counter-electrode is provided with channels embossed, on the one hand, for the purpose that the air can outstream into a back volume of the transducer from the air gap defined by the membrane and the counter-electrode and, on the other hand, the damping losses in the air gap are reduced. However, the sensitivity of the known microphones is lowered and the frequency response curve is unfavorably influenced. The signal conversion is effected by evaluating the relative capacitance change of the transducer.

Recent advances in semiconductor technology permit the manufacture of miniature transducers by micromechanical means, for example on the basis of silicon. The technical literature contains an article entitled "KAPAZITITITVE SILIZIUMSENSOREN FUER HOERSCHALLANWENDUNGEN", (translated as "Capacitive Silicon Sensors for Acoustic Application"), which appeared in 1986 in the VDI-VERLAG ISBN 3-18-146010-9, wherein the construction of a silicon microphone is described. This transducer, which has been manufactured by micro-mechanical means has the dimensions of about 1.6 mm×2 mm×0.6 mm. The active membrane surface consists of a metallic layer which is covered by a silicon nitrate layer, which is separated by an air gap from a confronting counter-electrode that is also made of silicon.

The semiconductor technology manufactured miniature microphones have some significant drawbacks, however, which are caused by damping losses in the very narrow air gaps. When the membrane is stimulated to oscillation by a periodic pressure change, a streaming resistance forms in the air gap. This streaming resistance is much higher the smaller the air gap is, since the losses in the first instance occur due to friction at the walls. The streaming resistance is, moreover, frequency dependent; it increases with increasing frequency, so that the sensitivity at higher frequencies is considerably lowered. Since the damping losses do not increase linearly with a gap narrowing, the negative influence in microphones of the aforedescribed type is particularly high. The ability to perforate the counter-electrode is not practical because of its small size and because of a technology gap which exists at present. The microphones which are described in the aforementioned literature have their sensitivity lowered as a result of the air gap losses by values under −60 dB, relative to 1 V/Pa and the frequency response is limited to several kilohertz.

SUMMARY OF THE INVENTION

Air gap damping, which occurs between the membrane and a counter-electrode, can be reduced by reducing the lateral measurements of the counter-electrodes, that is the measurements normal to the streaming direction of the air. By means of such reduction in size, there is also lowered the static (resting) capacitance of the transducer. The lower limit of the latter resides, in view of the amplitude of the gain signal in the lower frequency-circuit, at about 1 pF. A reduction of the counter-electrode size, which could contribute to a reduction of the streaming resistance, no longer comes into play with such a reduced rest capacitance.

The invention has an object, to provide a miniature microphone manufactured by means of semiconductor technology, where the active surface of the membrane, relative to a good degree of effectiveness as with heretofore known microphones, is maintained, but where the damping losses which appear in the air gap are reduced by means of a suitable construction of the counter-electrode to such an extent that the drawbacks of the heretofore known microphones are avoided.

If one starts with the principle that the output signal of the transducer can be increased by the relative change of its static capacitance, then a substantially reduced lateral measurement of the counter-electrode, which forceably leads to a reduction of the damping losses, can be utilized.

According to the invention, there can be utilized smaller static capacitance if one controls, by means of the movement of the membrane, the input capacitance of a active element.

Field effect transistors (FETs) possess gate channel capacitances in the region of $10^{-15}$F, also of 1/1000 of the above mentioned counter electrode capacitance of 1 pF. If the source-to-drain channel structure of a field effect transistor is arranged relative to a membrane, then the streaming losses are, as a result of the required very reduced measurements of the counter-electrode structure, preponderately eliminated. This effect appears already when the breadth of the counter-electrode structure is about 1/10 of the measurement of the active membrane surface.

BRIEF DESCRIPTION OF THE DRAWING

With these and other objects in view, which will become apparent in the following detailed description, the present invention, which is shown by example only, will be clearly understood in connection with the accompanying drawing, in which.

DESCRIPTION OF THE PREFERRED EMBODIMENT

Figure 1:
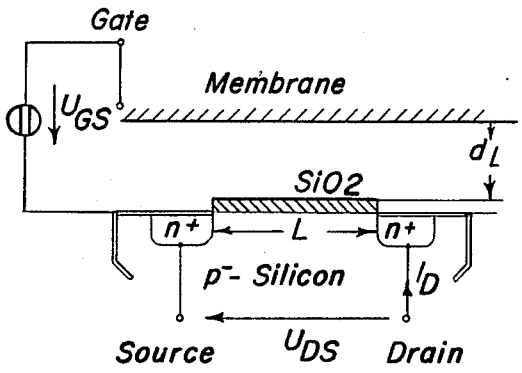
FIG. 1 is a schematic diagram of a sound transducer in accordance with this invention.

The fundamental construction of a capacitive sound transducer in accordance with the invention, hereinafter referred to as a FET microphone is illustrated in FIG. 1. A membrane, for example a membrane metallized by means of aluminum, is disposed and separated by means of an air gap $d_L$, about a source-to-drain channel structure, which is hereinafter referred as a counter-electrode structure. The channel zone of such structure is preferably covered by means of an oxide-protective layer. A weak p-doped silicon substrate preferably forms the channel zone L, and strongly n-doped electrodes preferably form the drain and source of an FET, thus forming, for example, an N-channel-enhancement (channel-enrichment) type FET.

Voltage $U_{GS}$, is applied between the membrane and the source connection and determines the working point of the field effect transistor.

Figure 3A:
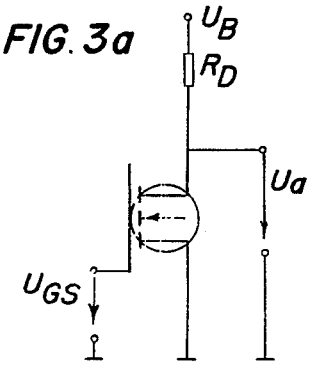
FIG. 3*a* is a schematic disgram of a basic FET microphone circuit.
Figure 3B:
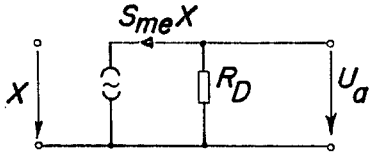
FIG. 3*b* is a schematic diagram of a small signal replacement circuit.

The FET microphone is advantageously operated in a source circuit. This is illustrated in FIG. 3*a* and the small signal replacement circuit of FIG. 3*b*. The source electrode is connected to a common reference voltage whereas the drain electrode is mounted via working $R_D$ at the operating voltage $U_B$. The microphone membrane corresponds to the gate of an FET and is pre-charged (biased) with the voltage $U_{GS}$ relative to the reference voltage. The operating voltage $U_B$ is conducted to the microphone via the drain resistance $R_D$, which can be immediately integrated on the chip forming the counter-electrode. At the drain connection, the microphone output voltage $U_a$ is picked off. The membrane is pre-charged relative to the source with the voltage $U_{GS}$.

In the illustrated small signal replacement circuit of FIG. 3, the current source with the mechanical-electrical trans-conductance $S_{me}$ is controlled by means of the membrane deviation X. The impregnated current produces in the drain resistance $R_D$ a voltage drop, which corresponds to the output voltage $U_a$.

Figure 2:
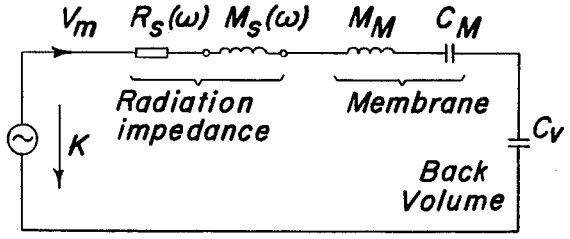
FIG. 2 is a schematic diagram of a mechanical network circuit.

In calculating the frequency response and sensitivity of the FET microphones, the mechanical network schematic illustration can be seen in FIG. 2. $R_S(W)$ and $M_S(W)$ represent the radiation impedance $Z_{mS}$ of the membrane. $M_M$ represents the mass and $C_M$ the compliance (yieldability) of the membrane, which oscillates with the velocity of $m_m$. The back air volume is represented by the resilience $C_V$. The input force $K=p\times A$ is derived from the membrane surface A and the pressure differential p which prevails in front of the membrane.

On the basis of the frequency dependency of the radiation impedance, there must be differentiated two valid ranges for the network circuit schematic illustration.

Below about 155 kHz there is valid for the radiation impedance $Z_{mS}$:

$Z_{mS}=R_S+jwM_S$, where $R_S=2.245\times10^{-16}$ kg sec$\times w^2$ and $M_S=3.163\times10^{-10}$ kg.

The variable w is used to represent the greek letter omega which equals "2 pi f", the angular frequency, the frequency expressed in radians per second, i.e. the frequency in cycles per second multiplied by 2 pi. The variable j is the imaginary number the square root of $-1$.

Above about 155 kHz, there results for the radiation impedance:

$Z_{mS}=R_S+jwM_S$, where $R_S=2.840\times10^{-4}$ kg/sec and $M_S=(240.5\ \text{kg/sec}^2)/w^2$ The membrane element dynamic mass $M_M$ and resiliences $C_M$ have the values:

$M_M=7.384\times10^{-10}$ kg; and $C_M=1/30T$ (Tensile stress T in N/m in the region 20–200 N/m).

For the resilience of the back air volume V there is valid:

$C_V=V/p_O C^2 A_{eff}^2$

As effective cross-sectional surface $A_{eff}$, there is applied the membrane surface, $A_{eff}=A$. The volume results from the wafer thickness, which represents the back volume magnitude. It amounts to 280 um. There from follows for $C_V$:

$C_V=2.866\times10^{-3}$ sec$^2$/kg.

Mass, resilience and friction losses of the air in the air gap can be disregarded, since the width of the air gap and the width of the source-to-drain channel structure are correspondingly substantially smaller than the lateral measurements of the membrane and the openings of the back volume.

The feedback of the electrical part of the FET microphone onto its mechanical properties drops out, since the membrane of the electrical field is driven in the air gap by means of the voltage $U_{GS}$ in a low-ohmic manner.

With conventional condenser microphones in low frequency circuit there can, however, not be neglected the mechanical behavior of the transducer in response to the circuit connected to the transducer. Input resistance and input capacitance of the pre-amplifier produces a damping and a transformd "electrical" resilience which is introduced into the oscillation behavior of the membrane and thereby introduced into the behavior of the entire transducer.

For the mechanical impedance $Z_m$ there results:

$Z_m=K/v_m=Z_{mS}+jwM_M+1/jwC_{ges}$, whereby $C_{ges}=(1/C_M+1/C_V)^{-1}$.

With $v_m=jwx$ and membrane surface A there results:

$U_a=-S_{me}\times R_D=-S_{me}R_D V_m/jw=-S_{me}R_D\cdot pA/jwZ_m$.

For the microphone sensitivity $M_e$ and its frequency behavior there follows:

$M_e=U_a/p=-S_{me}R_D A/jwZ_m=-S_{me}R_D AC_{ges}\times 1/(1-w^2M_M C_{ges}+jwZ_{mS}C_{ges})$ It can be recognized that the microphone sensitivity increases proportionally with the mechanical-electrical trans-conductance $S_{me}$ and drain resistance $R_D$. These can not, however, be randomly increased, since the available level of the operating voltage $U_B$ and the maximum adjustable electrical membrane voltage $U_{gs}$ (field strength in the channel) represent upper limits. A large total resilience $C_{ges}$ requires a "soft" membrane (high resilience $C_M$) and a large back volume ($C_V$). Also here certain limits prevail. The small membrane surface A of subminiature transducers represents an inherent problem.

Figure 4:
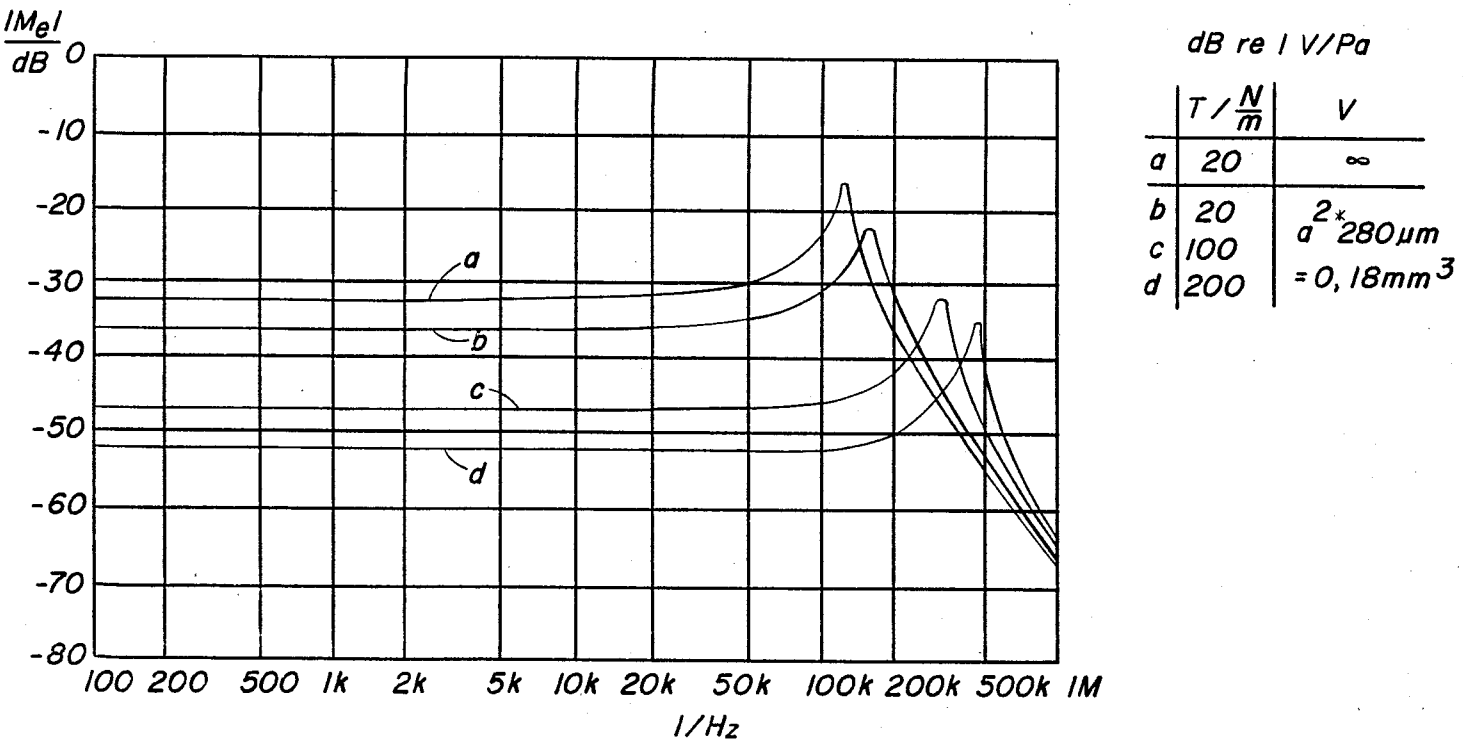
FIG. 4 is a frequency response diagram.

A graphic representation of the dependency of the sensitivity $M_e$ on the frequency is illustrated in FIG. 4 for various mechanical membrane stresses and back volumes.

Figure 5:
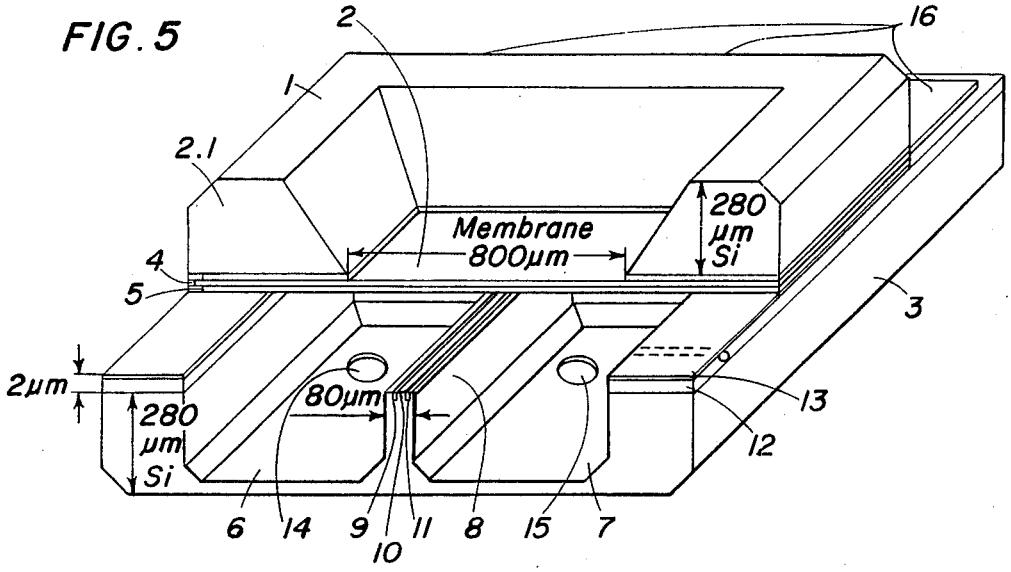
FIG. 5 is a partial cross section perspective view of a sound transducer in accordance with the invention.

An advantageous specific embodiment of a capacitive sound transducer in accordance with the invention is described in conjunction with FIG. 5. The FET microphone comprises two chips, of which the upper represents a membrane unit 1 which supports the membrane 2 and the lower represents a counter-electrode structure 3 which supports the source-to-drain channel structure 9, 10, 11 of the FET.

The membrane 2 preferably consists of a 150 nm thick layer 4 made of silicon nitrate, the mechanical stress properties of which can be influenced by means of ion implantations during the manufacturing process. The membrane 2 is supported by a supporting frame 2.1 which surrounds the membrane by means of walls and which consists of a semiconductive base material, preferably silicon. A vapor applied 100 nm thick aluminum layer 5 covers its lower side. This vapor application represents the gate of the FET.

In the lower chip there are introduced by for example means of plasma etching two troughlike grooves 6 and 7, which form the back volume of the microphone. Between the two grooves there is disposed an 80 um wide cross piece 8, which supports the source-to-drain channel structure 9, 10 and 11 of the FET. The distance of the chanel 10 to the aluminum layer 5 of the membrane 2 amounts of 2 um.

Figure 6:
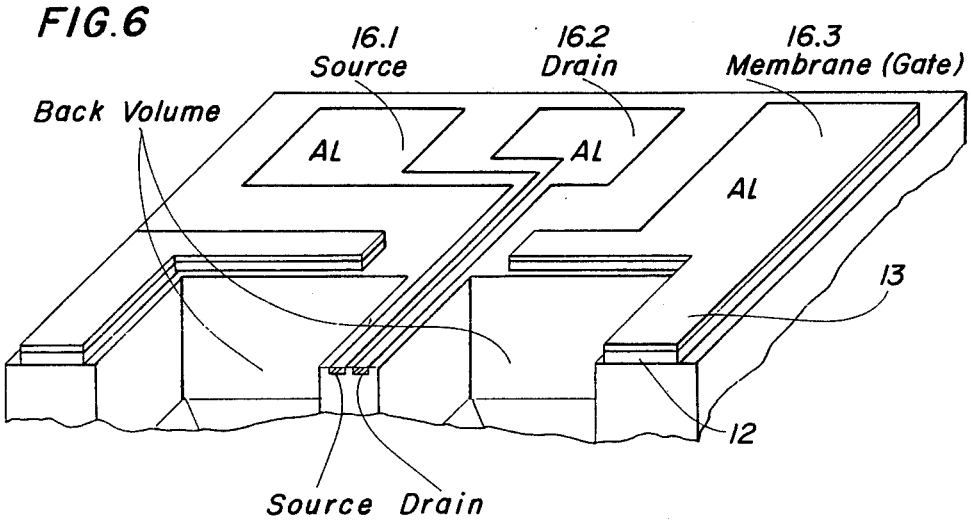
FIG. 6 is a perspective cross sectional view of an exemplary arrangement of contact pads.

Referring to FIG. 6, on the counter-electrode structure 3 there mounted three contact pads 16.1–16.3 for source contact, drain contact, and the aluminum layer of the membrane, which represents the gate-contact.

A compensation for the static air pressure is provided by silicon edge 12 of the counter-electrode chip insofar as the microphone capsule of the pressure transducer is to operate with an acoustic sealed volume.

The process steps for manufacturing the chips for the membrane unit 1 as well as the chips for the counter-electrode structure 3 are known to those skilled in the semiconductor technology art and do not need to be described further here.

In order to make possible the joining of the two semiconductor chips, there is further applied to the silicon oxide layer 12 an aluminum layer 13. Both chips (1, 3) are joined to each other only by heating them, whereby the confronting aluminum surfaces 5 of the membrane unit 1 and 13 of the counter-electrode unit 3 melt into each other.

The transducer illustrated in FIG. 5 can also be expanded into a push-pull transducer, in which a second counter-electrode structure with a suitably shaped cross-piece 8 can be introduced into a given indentation of the membrane unit 1. In such a case, the membrane 2 must be coated on both sides by a metallization.

If the transducer is to operate as a push-pull transducer in the described manner, or, according to another advantageous embodiment is to receive a pressure gradient characteristic, then the respective volumes disposed behind the membrane are joined with the outer acoustic field via openings. In FIG. 5 such openings are designated, for example, by dotted lines with the reference numbers 14 and 15. Dotted lines are used to represent openings 14 and 15 in FIG. 5 in order to illustrate that in one embodiment the structure of FIG. 5 includes openings 14 and 15 providing a pressure gradient characteristic) and in another embodiment the structure of FIG. 5 is employed without openings 14 and 15 (whereby a pressure transducer characteristic is obtained).

The counter-electrode structure for the canal zone in the above described construction is the N- or P- channel-enhancing principle. In an advantageous manner, however, the depletion principle can also be used for the channel zone. Since there is already predetermined a working point in the FET circuit, the special precharged voltage for the gate can be dispensed with, since it can be self-produced in a known manner via a resistance placed in a source-current circuit.

As is known from the production methods of integrated circuits, many identical constructional units can be simultaneously manufactured on a so-called wafer and later separated from each other. With the manufacture of capacitive sound transducers in accordance with the invention it is now also possible, to manufacture many micro-microphones on a wafer, but not to individually separate them from each other, but rather to separate from each other specially formed groups of micro microphones. For example, by maintaining a row of a plurality of adjacent microphones and their electrical interconnection and supporting circuits on a single chip, it is possible to obtain an interference-directional microphone.

A significant advantage with a capacitive transducer in accordance with the invention is that a relatively large active membrane surface, which is required for a good acoustic efficiency of the transducer, has only a small portion confronting the counter-electrode structure and thereby make the air gap negligibly small. Thereby there results a large linear transfer region with a very good sensitivity, as can be recognized from FIG. 4. Moreover, the noise behavior of the transducer is extraordinarily favorable since the damping in the air gap brings about a noise portion which is on the basis of principle very low.

Capacitive transducers are for the most part operated in the so-called low frequency circuit and require therefor a pre-resistance, the thermic noise of which also increases with increasing resistance values. Lowering transducer rest capacitances with miniature microphones require with the same lower frequency limit however, larger pre-resistance values, whereby with the heretofore known constructions this constituted an unsolvable problem.

Since the FET microphone requires no pre-resistance, the noise portion is also substantially reduced.

The noise behavior can also be improved in that a plurality of FET microphones can be formed on a single wafer and connected in parallel as a microphone unit on a wafer and operated at such.

Although the invention is described and illustrated with reference to a plurality of embodiments thereof, it is to be expressly understod that it is in no way limited to the disclosure of such preferred embodiments but is capable of numerous modifications within the scope of the appended claims.

We claim:

1. Capacitive sound transducer comprising a first and a second semiconductor chip, the first semiconductor chip comprising a membrane unit and the second semiconductor chip comprising a counter-electrode structure, the first semiconductor chip being affixed to the second semiconductor chip;

an acoustic active portion of the membrane unit being separated from the counter-electrode structure by means of an air gap;

said membrane unit comprising semiconductive ground material and said acoustic active portion of said membrane unit having an electrically conductive surface confronting said counter-electrode structure;

said counter-electrode structure comprising a channel defining a source-drain arrangement operating according to field effect principle, whereby said acoustic active portion of the membrane unit and said counter-electrode structure form a sound transducer system;

said channel having a geometric width measurement and said acoustic active portion of said membrane unit having a geometric width, the width of the channel being on the order of magnitude of a tenth of the width of the acoustic active portion of the membrane unit.

2. Capacitive sound transducer as claimed in claim 1, wherein ground material for the membrane unit and the counter-electrode structure comprises silicon; and the active surface of the membrane unit consists of a silicon nitrate-layer, which is vaporized with aluminum and a mechanical tension of which is determined by ion implantation.

3. Capacitive sound transducer as claimed in claim 1 wherein said channel of said counter-electrode structure operates accorting to FET channel enriching principle.

4. Capacitive sound transducer as claimed in claim 1 wherein said channel of said counter-electrode structure operates accorting to FET channel depletion principle.

5. Capacitive sound transducer as claimed in claim 1 wherein said counter-electrode structure contains an enclosed volume thereby effecting a pressure transducer characteristic.

6. Capacitive transducer as claimed in claim 1 wherein said counter-electrode contains a substantially enclosed volume with openings effecting a pressure gradient characteristic.

* * * * *